US007255120B2

(12) United States Patent
Garza, Sr. et al.

(10) Patent No.: US 7,255,120 B2
(45) Date of Patent: Aug. 14, 2007

(54) MOBILITY-AID APPARATUS AND METHOD WITH CORES HAVING NEGATIVE DRAFT

(75) Inventors: Jesus Garza, Sr., Sunnyvale, CA (US); Richard W. Benner, Morgan Hill, CA (US); Jeremy Gin, Sunnyvale, CA (US); Jerry Gin, Sunnyvale, CA (US)

(73) Assignee: Hessa Medical, Inc., Sunnyvale, CA (US)

( * ) Notice: Subject to any disclaimer, the term of this patent is extended or adjusted under 35 U.S.C. 154(b) by 36 days.

(21) Appl. No.: 10/364,577

(22) Filed: Feb. 10, 2003

(65) Prior Publication Data

US 2004/0025924 A1 Feb. 12, 2004

Related U.S. Application Data

(60) Provisional application No. 60/401,630, filed on Aug. 6, 2002.

(51) Int. Cl.
*A61H 3/02* (2006.01)

(52) U.S. Cl. ..... 135/68; 135/69; 135/75; 248/157

(58) Field of Classification Search ..... 135/68, 135/65, 69, 67, 71, 75, 76; 248/125.8, 161, 248/157

See application file for complete search history.

(56) References Cited

U.S. PATENT DOCUMENTS

| | | | | | |
|---|---|---|---|---|---|
| 1,358,643 | A * | 11/1920 | Lamming | 135/72 |
| 2,541,609 | A * | 2/1951 | Pullan | 43/18.1 R |
| 2,630,128 | A * | 3/1953 | Slater | 135/69 |
| 2,787,484 | A * | 4/1957 | Macy | 403/52 |
| 3,635,233 | A * | 1/1972 | Robertson | 135/71 |
| 3,669,133 | A * | 6/1972 | Hyman | 135/74 |
| 3,886,962 | A * | 6/1975 | Diamontis | 135/69 |
| 3,987,807 | A * | 10/1976 | Varnell | 135/66 |
| 4,490,063 | A * | 12/1984 | Aho | 403/109.8 |
| 4,947,882 | A * | 8/1990 | Levasseur | 135/84 |
| 4,979,533 | A * | 12/1990 | Hansen et al. | 135/69 |
| 5,149,092 | A * | 9/1992 | Parsons | 463/47.7 |
| 5,868,621 | A * | 2/1999 | Parsons | 463/47.7 |
| 6,085,766 | A * | 7/2000 | Geary | 135/75 |
| 6,206,019 | B1 * | 3/2001 | Horvitz | 135/74 |
| 6,938,927 | B1 * | 9/2005 | Martin et al. | 280/819 |
| 2004/0025923 | A1 * | 2/2004 | Garza et al. | 135/68 |

OTHER PUBLICATIONS

Plastics Engineering Handbook of the Society of the Plastics Industry, Inc.; 4th Edition, 1976, p. 653.

* cited by examiner

*Primary Examiner*—Anita M. King
(74) *Attorney, Agent, or Firm*—James F. Hann; Haynes Beffel & Wolfeld LLP

(57) ABSTRACT

Apparatuses and methods assist in mobility of a person. According to an embodiment of the invention, a device for enhancing mobility of a physically-impaired person comprises: a first member that comprises an elongated portion; and a second member that is configured to slidably receive the elongated portion of the first member and to have negative draft relative to the elongated portion of the first member. According to another embodiment of the invention, there is a method for producing an apparatus for assisting in ambulation. The method comprises the steps of: providing a first member that comprises an elongated portion; and providing a second member, including: forming a recess in the second member for slidably receiving the elongated portion of the first member; and tapering the recess to have negative draft relative to the elongated portion of the first member.

22 Claims, 15 Drawing Sheets

MOBILITY-AID APPARATUS AND METHOD WITH CORES HAVING NEGATIVE DRAFT

RELATED APPLICATION(S)

The present patent application is related to and claims the benefit of priority from commonly-owned U.S. Provisional Patent Application No. 60/401,630, filed on Aug. 6, 2002, entitled "MOBILITY-AID APPARATUS AND METHOD", which is hereby incorporated by reference in its entirety for all purposes.

BACKGROUND OF THE INVENTION

Mobility aids including crutches of various designs have long been used to assist people with injuries or other temporary or permanent disabilities. In order to accommodate users having diverse body dimensions, typical commercially available crutches are adjustable in overall height and in the position of a handle along the overall height. A typical commercially produced crutch has body components made of wood (see, e.g., U.S. Pat. No. 815,368) or aluminum (see, e.g., U.S. Pat. No. 4,838,291). Such body components typically have multiple holes by which they can connect to one another using metal bolts and metal wing nuts. Depending on the particular holes selected for use, overall height and handle position is determined. Typically, there is only one adjustment point for the overall height.

Despite their long history of existence, conventional crutches have problems of being uncomfortable to use due to their rigidity, expensive to produce due to their complexity, and expensive to produce and keep as inventory due to a need for multiple sizes of crutches caused by the limited height adjustability of any one crutch. Another problem is that metal components used in crutches tend to trigger metal detector alarms, for example, at airports.

SUMMARY OF THE INVENTION

According to an embodiment of the invention, a device for enhancing mobility of a physically-impaired person comprises: a first member that comprises an elongated portion; and a second member that is configured to slidably receive the elongated portion of the first member and to have negative draft relative to the elongated portion of the first member.

According to an embodiment of the invention, an apparatus for helping to support weight of a person during ambulation comprises: a first stage that includes an elongated portion; and a second stage that defines a cavity that slidably receives the elongated portion of the first stage along an axis of sliding, the cavity having an opening that receives the elongated portion of the first stage, the second stage including an internal sidewall facing the cavity, at least a portion of the internal sidewall being tapered relative to the axis of sliding, wherein a first point on the internal sidewall deviates more, from the axis of sliding as envisioned centrally in the cavity, than does a second point on the internal sidewall, the first point on the internal sidewall being deeper in the cavity along the centrally-envisioned axis of sliding than the second point on the internal sidewall.

According to an embodiment of the invention, a method for producing an apparatus for assisting in ambulation comprises the steps of: providing a first member that comprises an elongated portion; and providing a second member, including: forming a recess in the second member for slidably receiving the elongated portion of the first member; and tapering the recess to have negative draft relative to the elongated portion of the first member.

BRIEF DESCRIPTION OF THE DRAWINGS

In order to more fully describe specific embodiments of the present invention, including the currently preferred embodiments of the invention and the currently known best mode of the present invention, reference is made to the accompanying drawings. Understand that these drawings are not to be considered limitations in the scope of the invention, but are merely illustrative.

Throughout the views, like reference numerals refer to like parts.

DETAILED DESCRIPTION OF SPECIFIC EMBODIMENTS

Reference will now be made in detail to the following specific embodiments of the invention, examples of which are illustrated in the accompanying drawings. While the invention will be described in conjunction with the specific embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims. While the preferred embodiments are presented in the form of an underarm crutch, the invention could be embodied as, or incorporated into, a wide range of mobility assisting devices including, for example, forearm crutches or walkers or the like. For example, a forearm crutch embodiment may differ from an underarm crutch by being shorter overall and by having, not an underarm saddle, but a forearm contact.

Additional embodiments of the present invention are discussed in the following commonly-owned U.S. Patent Applications, filed on the same day as the present patent application, which are hereby incorporated by reference in their entirety for all purposes:

- U.S. patent application Ser. No. 10/364,605, entitled "Adjustable Mobility-Aid Apparatus That Avoids Triggering Alarms";
- U.S. patent application Ser. No. 10/364,126, "entitled Mobility-Aid Apparatus and Method Using Multiple Height Adjustments";
- U.S. patent application Ser. No. 10/364,091, entitled "Apparatus and Method for Producing a Mobility-Aid Apparatus Having a Hollow Core";
- U.S. patent application Ser. No. 10/364,180, entitled "Mobility-Aid Apparatus and Method Using Integrated Tabs";
- U.S. patent application Ser. No. 10/361,977, entitled "Mobility-Aid Apparatus and Method Using Tabs on Non-Boundary Region";
- U.S. patent application Ser. No. 10/364,086, entitled "Mobility-Aid Apparatus and Method Using Members That Resist Rotation";
- U.S. patent application Ser. No. 10/364,059, entitled "Mobility-Aid Apparatus and Method Having Ground Contact Pad Without Intervening Washer";
- U.S. patent application Ser. No. 10/364,082, entitled "Apparatus and Method for Maintaining Ground Contact of a Mobility-Aid Apparatus at Varying Angles";
- U.S. patent application Ser. No. 10/364,642, entitled "Shock Absorbing Apparatus and Method for a Mobility-Aid Device Using Limited Range of Compression".

Figure 1A:
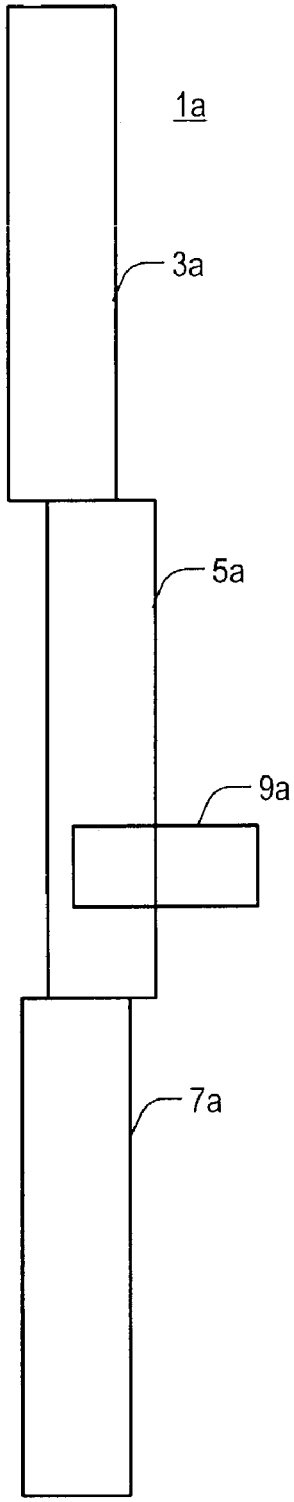
FIG. 1A includes a schematic diagram of an embodiment of the invention.

FIG. 1A includes a schematic diagram, in elevation view, of an embodiment of the invention. According to the embodiment of the invention, a crutch 1*a* includes an upper component 3*a*, a middle component 5*a*, a lower component 7*a*, and a handle 9*a* that are adjustably interconnected. Three vertical adjustments relative to the middle component allow the crutch to accommodate a large range of user heights and arm lengths. The three adjustments are of the upper component 3*a*, the handle 9*a*, and the lower component, respectively. The large range is of advantage to manufacturers, hospitals, and distributors, which otherwise would need to produce, buy, and/or stock several sizes of conventional crutches (typically medium adult, tall adult, child, and small child). Thus the embodiment of the invention replaces several sizes of crutches with a single model.

The embodiment of the invention can be composed mostly or entirely of polymeric material, for example, high strength plastic such as xenoy, nylon, polypropolene, peat, or the like. The plastic can be plastic filled with glass, wood, other strengthening additives, or the like. Furthermore, parts that move relative to each other during crutch use can be lubricated externally or with an additive, for example, silicone, or the like. According to a particular embodiment of the invention, glass filled nylon having about 30% glass content produces good strength and low weight and costs of the crutch. The composition of the crutch, including for example, proportion of glass content, may be changed to accommodate changes in material costs, crutch design, manufacturing procedures, customer preferences, other market forces, or the like.

Figure 1B:
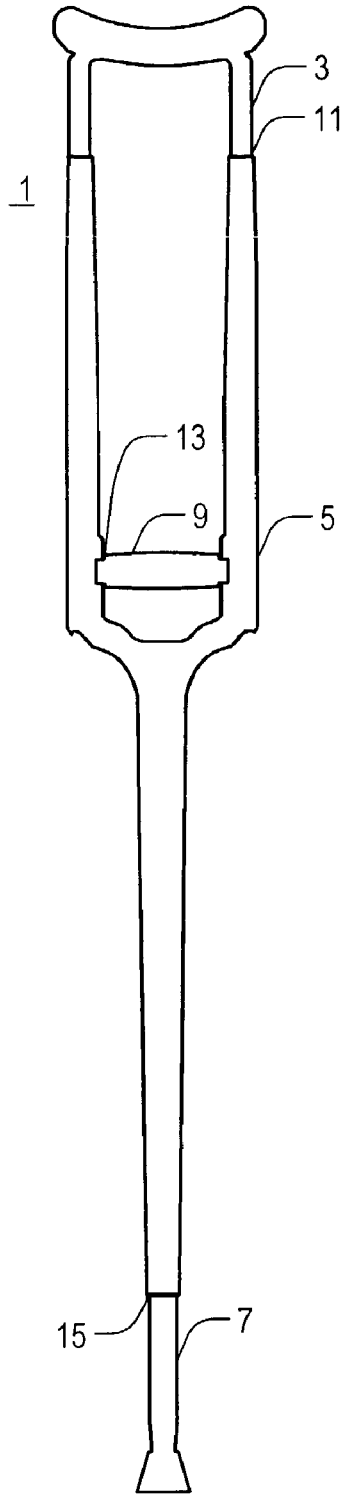
FIG. 1B includes an outline diagram of a crutch that embodies the invention.

FIG. 1B includes an outline diagram, in front elevation view, of an embodiment of the invention, namely, a crutch 1 that embodies the crutch 1*a* of FIG. 1A. (In the drawings of the crutch 1, the view shown in FIG. 1B is called the "front view", for convenience. It will be appreciated that, when the crutch is held underarm for use by a person, the "front" face of the crutch as seen in FIG. 1B will face a direction that is generally sideways of the person and not frontward of the person.)

The crutch 1 includes an upper component 3, a middle component 5, a lower component 7, and a handle 9. For convenience, the just-mentioned components 3, 5, 7 will also be referred to as the underarm component 3, the main body component 5, and the shaft 7, respectively. Of course, it would be, and it is to be, understood that in some other similar embodiments of the present invention, elements corresponding to the underarm component 3 might not be intended to fit "underarm" (e.g., for forearm crutches), and elements corresponding to the shaft 7 might not take the form of a "shaft", and elements corresponding to the main body component 5 might not be considered to be "main". Components 3 and 5 have a junction 11. Components 5 and 9 have a junction 13. Components 5 and 7 have a junction 15. Relative positions of components 3, 5, 7, and 9 can be adjusted such that the junctions 11, 13, and 15 would be at different positions on the components.

Figure 2C:
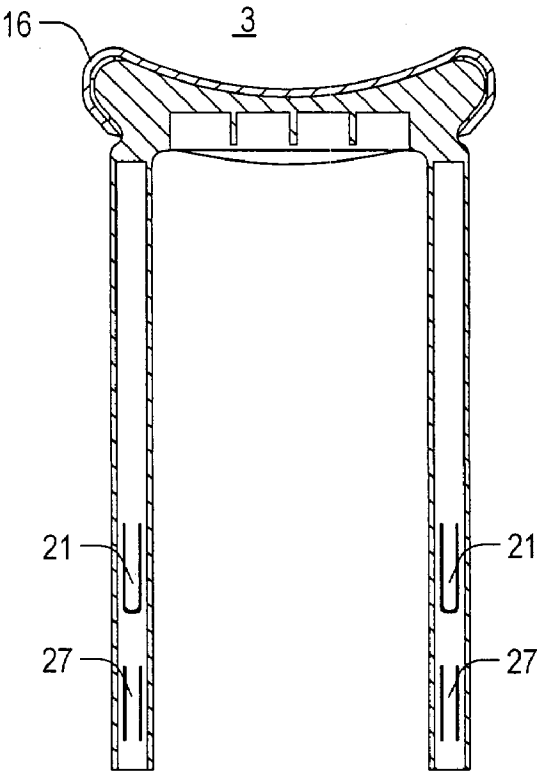
FIGS. 2A, 2B, and 2C include views of an upper component of the crutch.
Figure 2B:
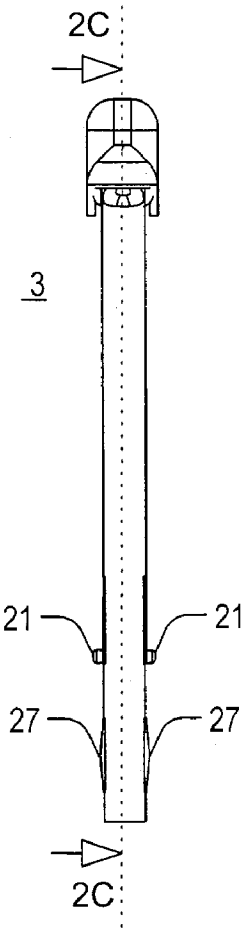
Figure 2A:
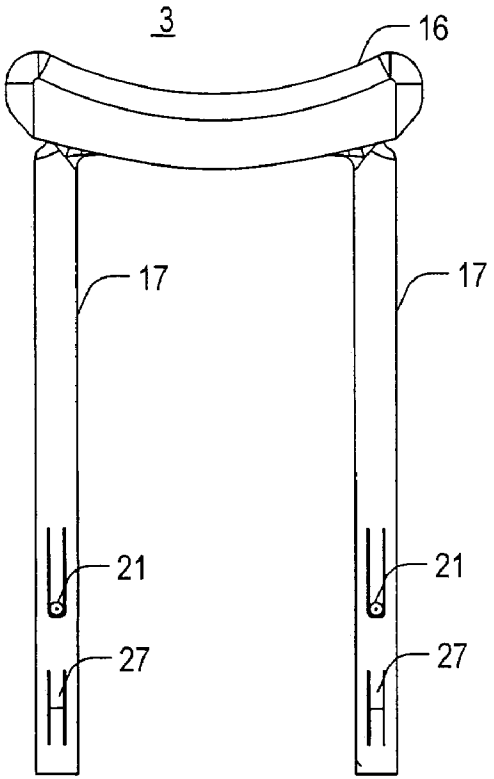
Figure 3A:
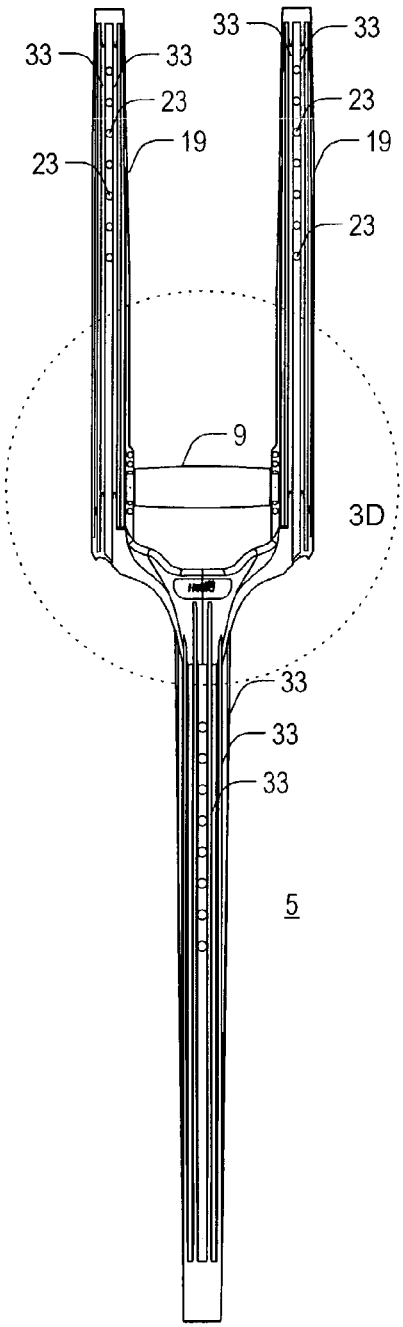
FIGS. 3A, 3B, and 3C include views of a middle component of the crutch.
Figure 3B:
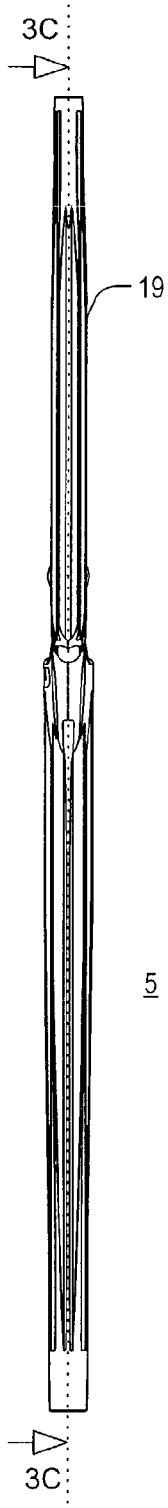
Figure 3C:
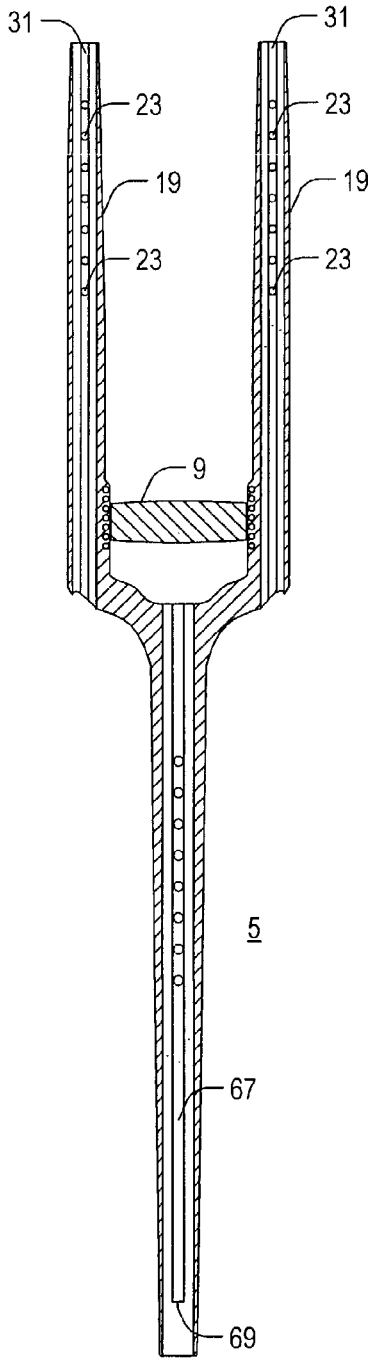

FIGS. 2A, 2B, and 2C include, respectively, a front elevation view, a side elevation view, and a front section view of an embodiment of the upper component 3 shown in FIG. 1B. FIGS. 3A, 3B, and 3C include, respectively, a front elevation view, a side elevation view, and a front section view of an embodiment of the middle component shown in FIG. 1B.

The underarm component 3, as embodied, accommodates a padded underarm saddle pad 16 and includes at least one (two are shown) downwardly extending post 17. The main body component 5 includes a corresponding number of upwardly extending hollow posts 19 (two are shown) that are open at top to accept the downwardly extending posts in telescoping manner. Spring pins 21 are molded into the underarm component 3. The hollow posts 19 have sidewalls that have vertically spaced holes that are configured to receive the spring pins 21. Crutch height is easily adjusted by telescoping the downwardly extending posts 17 into the upwardly extending hollow posts 19 and inserting the spring pins 21 into selected ones of the vertically spaced holes 23 to lock the crutch height. The inclusion of spring pins 21 integrally in the underarm support for locking vertical adjustment simplifies the crutch design, as conventional crutches have traditionally used separate spring pins or separate bolts.

For ease of manufacturing, the hollows of the hollow posts 19 can be other than perfectly cylindrical. Each of the hollows can be formed to have a taper, to facilitate withdrawal of a core mold from a molded hollow post 19. Generally, more taper means easier manufacturing. For example, a core mold need not be as polished and "non-stick" if it is being withdrawn from a core having a slight, favoring taper. Conversely, less taper, or no taper, can give a more precise feel to the apparatus by reducing looseness. In one embodiment, a taper of no more than about a 1/16 of a degree gives a good, precise feel. In another embodiment, a taper of at least 1/16 of a degree, gives greater ease and economy of manufacture, but preferably the taper is no greater than about 1/4 of a degree of taper, or, no greater than about 1/8 of a degree. In still another embodiment, a taper is greater than 1/8 of a degree, to give even greater ease of manufacture. Still other tapers are possible.

Figure 19:
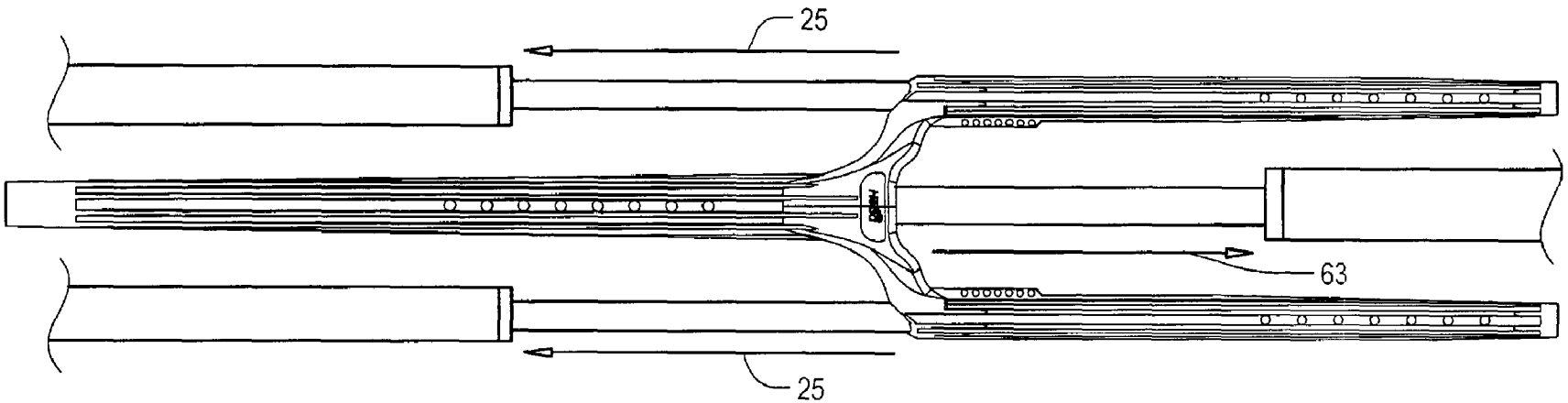
FIG. 19 includes a schematic diagram of the main body component and mold cores being withdrawn from the molded main body component in directions indicated by arrows.

Preferably, the taper is a negative draft with regard to the telescoping downwardly pointing underarm support posts of the underarm component 1. Such a negative draft gives a tighter fit at the mouth of the hollow, and makes the looseness less noticeable to the user, as compared to a hollow with a wider mouth. The negative draft is formed by a core mold for each hollow. The mold core is preferably withdrawn from the main body component in a "downward" direction 25 with respect to the main body component, as shown in FIG. 19. Thus, each hollow has positive draft with respect to its mold core.

Included in the underarm support posts 17 is a set of molded spring supports 27. These spring supports 27 keep the underarm support 3 stable relative to the main body component 5, especially given the negative draft of the hollows of the hollow posts 19, for example, by springing outward to meet the internal sidewalls despite the tapering of the sidewall away from the diameter of the underarm support post 17. The hollow that accepts the support post 17 may have a corresponding channel or keyway 31 into which the spring support 27 fits and against which the spring support 27 would push to help resist any relative rotation between the support post 17 and the hollow that accepts the support post 17. Thus, the spring support 27 is an example of a protuberance that fits into a corresponding keyway to resist rotation. Any other way of resisting rotation between mating components can also or instead be used. For example, other non-cylindrical shaped posts and corresponding receiving hollows may be used. For example, posts and hollows having polygon or star-shaped or ribbed cross sections may be used.

The main body component 5 is preferably a one-piece, all polymeric design (e.g., integrally reinforced plastic) with ribbing 33 to reduce weight while having adequate desired flexural strength. Conventional Finite Element Analysis can be used to select dimensions of the ribbing. The ribbing 33 also protects the snaps 21 in the upper component 3 and similar snaps in the lower component (which will be seen in later drawings) from inadvertent detent.

Figure 3D:
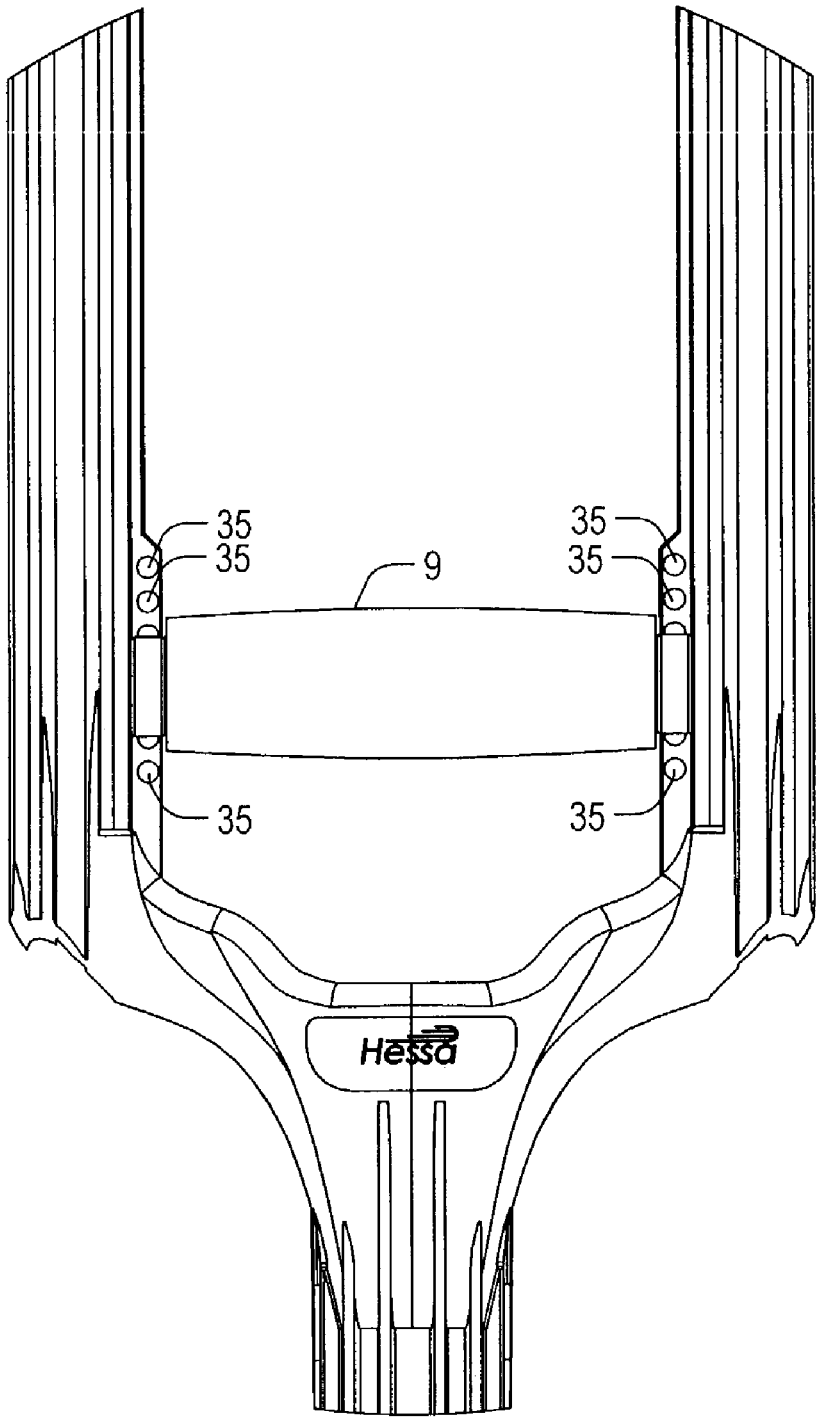
FIG. 3D includes an enlarged, fragmentary view of a portion, of the middle component, that includes the handle of the middle component.
Figure 4A:
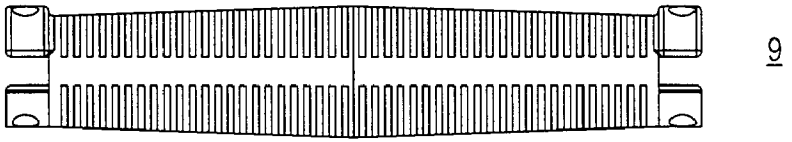
FIGS. 4A-4C include views of the handle.
Figure 4B:
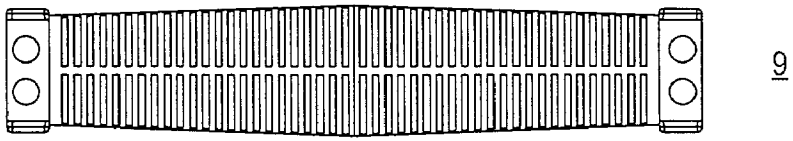
Figure 4C:
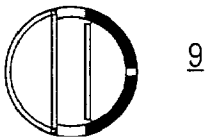
Figure 5A:
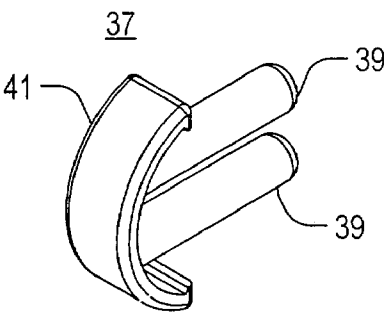
FIGS. 5A-5C include views of an adjustment pin for the handle.
Figure 5B:
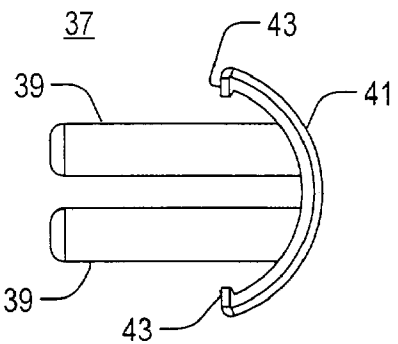
Figure 5C:
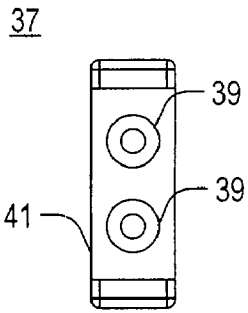

FIG. 3D includes an enlarged, fragmentary front elevation view of a portion, of the main body component of FIG. 3A, that includes the handle 9 of the main body component 5. FIGS. 4A-4C respectively include a front elevation view, a top view, and a side elevation view of the handle 9. The handle 9 is preferably adjustable in its height position along the crutch 1. The handle 9 may be ribbed to give strength at an economical weight. According to one embodiment, the crutch 1 includes removable pins for adjustment and placement of a crutch grip into selected ones of vertically spaced support holes 35 (see FIG. 3D) in the main body component 5. FIGS. 5A-5C respectively include a perspective view, a side elevation view, and a rear elevation view of an embodiment 37 of an adjustment pin. The adjustment pin 37 has at least one prong 39 (two are shown and are preferred) and has a crescent-shaped backplate 41. The adjustment pin 37 is configured to snap into place. As shown, the backplate 41 has hooks 43 that snap into place to hold the adjustment pin 37 in place. This particular design allows for independent handle replacement without requiring other parts to be removed or unlocked from the crutch. The pin 37 in a preferred embodiment is molded of polymeric material, but any other suitable material, e.g., metal, may be used.

Figure 6A:
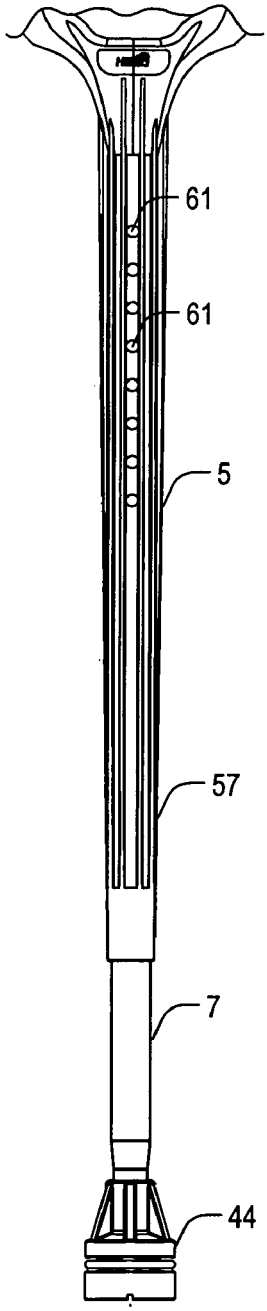
FIGS. 6A-6C include views of a lower component of the crutch as assembled to the lower portion of the middle component.
Figure 6B:
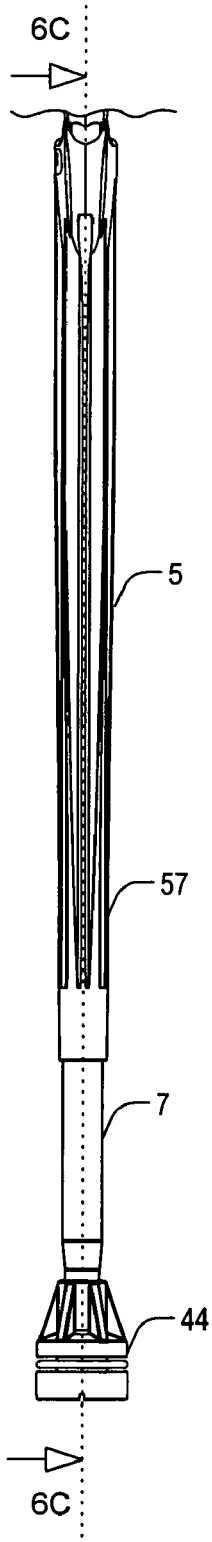
Figure 6C:
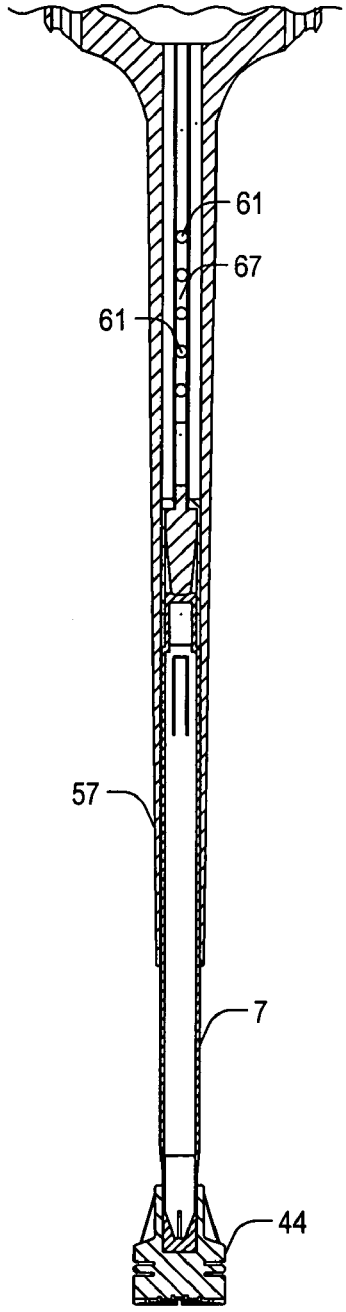

FIGS. 6A-6C include respectively a front elevation view, a side elevation view, and a front section view of the shaft 7 as assembled to the lower portion of the main body component 5. Only the lower portion of the main body component 5 is shown. The shaft 7 preferably includes a boot 44 at bottom.

The crutch 1 preferably includes a shock absorber. Preferably, the shock absorber is part of the lower component 7.

Figure 7A:
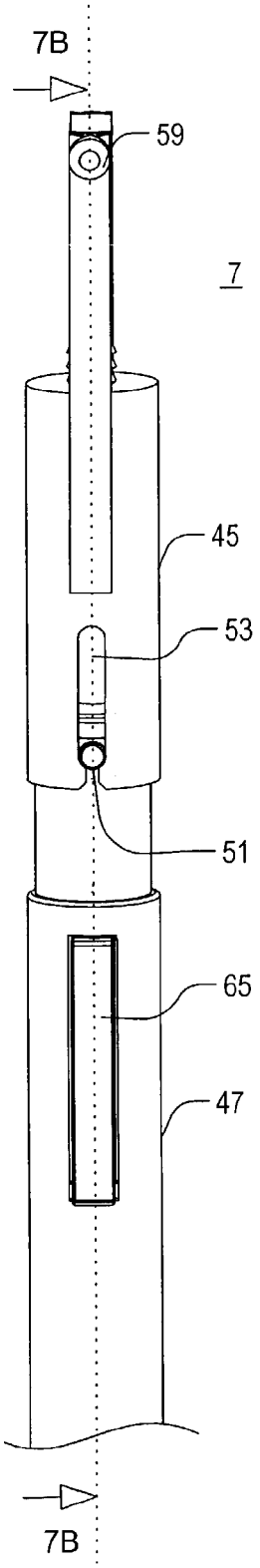
FIGS. 7A and 7B include fragmentary views of only an upper region of the lower component of the crutch.
Figure 7B:
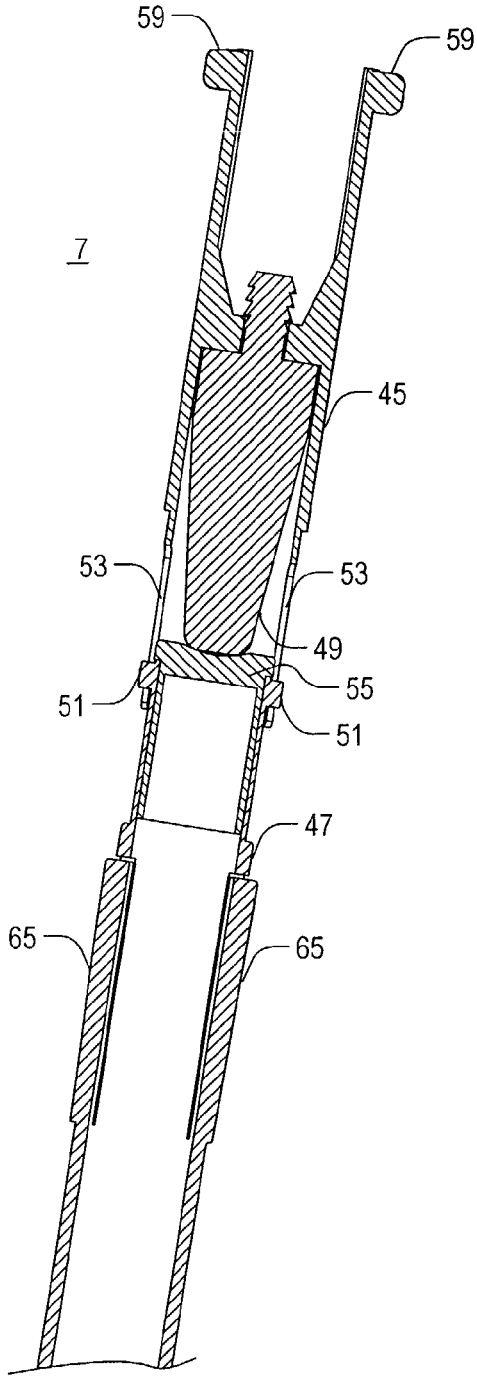

FIGS. 7A and 7B include respectively a front elevation view and a side section of only an upper region of the shaft 7. As a way to shrink overall length of the crutch 7 resiliently for shock absorption, the shaft 7 includes an upper shaft portion 45, a lower shaft portion 47, and a shock absorber 49 between the portions 45 and 47. The shock absorber 49 acts as a spring with a spring rate (also known as spring constant) that increases with the amount of weight applied, resulting in a similar shock absorbing feel to the crutch for users of varying weights (note: a spring constant measures the strength of the spring, where a higher value denotes a stronger spring).

For all springs:

$$F=-K\cdot X$$

where F is force applied to the spring, X is the deflection of the spring until the force is equalized by the spring, and K is the spring rate. For music wire and other conventional springs or pneumatic devices used in crutches, K is considered to be about constant, so as F (the weight applied by the crutch user) increases, X, the resulting deflection of the spring, increases about proportionately. This presents a practical problem that different springs are needed for crutch users of differing weights—e.g., if a user weighs too much, the spring will fully compress, whereas if the user doesn't weigh enough the spring will not compress adequately. However, the shock absorber 49 is configured to have a variable spring rate such that as F increases, K increases as well, allowing X to increase substantially less than proportionately with increases in F. For example, the preceding sentence would be true for a weight difference between two typical users of conventional crutches of different sizes (e.g., "medium adult" versus "tall adult", or "child" versus "tall adult", or any other pair of conventional sizes.)

The shock absorber 49 is made of a resilient material, for example, rubber, plastic, or the like, for example, neoprene, that has a cone-like shape. The shock absorber can also have any other shape having a section that increases in thickness from one end to the other. The shock absorber can also be any other type of variable-spring-rate spring, for example, a coil spring having variable coil diameter and/or variable coil density. Due to the nature of the shock absorber 49, the crutch provides similar shock absorbency to users of diverse weights with a single part. Furthermore, the use of a neoprene or other low durometer rubber or plastic with a good structural memory provides further improvement over other shock absorbing mechanisms.

The lower shaft portion 47 can slide axially relative to the upper shaft portion 45. The lower shaft portion 47 includes guide pins 51 that slide against guide slots 53 in the bottom edge of the lower sidewall of the upper shaft portion 45. The guide pins 51 and the slot 53, for example, were preferably molded into the molded portions 45 and 47. The guide pins 51 and guide slots 53 resist relative rotation by the upper and lower shaft portions 45 and 47. The guide pins 51 also form a locking mechanism that prevents the upper and lower shaft portions 45 and 47 from unintentionally separating.

The inner wall of the upper shaft portion 45 is dimensioned to closely fit around the upper outer wall of the lower shaft portion 47 in order to provide a tight engagement between the two components, while still allowing sliding movement between parts. The top of the lower shaft portion 47 includes a stepped cap 55 that has an upwardly facing concave indentation, which receives the shock absorber 49 and keeps the shock absorber centered.

As is shown in FIG. 6C, the main body component 5 includes a long downwardly pointing hollow post 57 that accepts the shaft 7. Referring again to FIGS. 7A-7B, the upper shaft portion 45 includes spring pins 59 for vertical adjustment of the crutch height that is in addition to the crutch height adjustment using the underarm component 3. The sidewall of the downwardly pointing hollow post 57 of the main body component 5 includes spaced holes 61 that accept the spring pins 59.

For ease of manufacturing, cavity of the main body component 5 that accepts the shaft can be other than perfectly cylindrical. As discussed above in connection with the hollow posts 19, the cavity can have a taper. Preferably, the taper is a negative draft with regard to the telescoping upwardly pointing shaft. The negative draft is formed by a mold core for the cavity. Referring to FIG. 19, the mold core is preferably withdrawn from the main body component in an "upward" direction with respect to the main body component, as shown by an arrow 63. Thus, the cavity has positive draft with respect to the mold core. In one embodiment of the crutch, a taper of no more than about a 1/16 of a degree gives a good, precise feel. In another embodiment, a taper of at least 1/16 of a degree gives greater ease and economy of manufacture, but preferably the taper is no greater than about 1/4 of a degree of taper, or, no greater than about 1/8 of a degree. In still another embodiment, a taper is greater than 1/8 of a degree, to give even greater ease of manufacture. Still other tapers are possible.

Referring again to FIGS. 7A-7B, the shaft 7 is kept from rotating relative to the main body component 5 (see, e.g., FIGS. 6A-6C) by supports 65, which, similarly to feature 27 from FIGS. 2A-2C, have a built-in springiness to provide a tight fit with the main body component 5 while allowing for negative draft of the cavity of the main body component 5 that accepts the shaft 7. The cavity that accepts the shaft 7 may have a corresponding channel or keyway 67 (see FIGS. 6C, 3C) into which the support 65 fits and against which the support 65 would push to help resist any rotation between the shaft and the cavity that receives the shaft. In this way, the support 65 and its corresponding keyway or channel 67 prevents or reduces any rotation-caused stress on pins 51 or 59 or both 51 and 59. Thus, the support 65 is an example of a protuberance that fits into a corresponding keyway to resist rotation. Any other way of resisting rotation between mating components can also or instead be used. For example, the ways discussed in connection with feature 27 of FIGS. 2A-2C can be used.

Additionally, the upper region of the shaft 7 is designed to prevent complete removal of the entire shaft 7 from the bottom of the main body component 5. The internal keyway 67 in the main body component 5 terminates near the end of the bottom of the main body component 5 (see termination 69, FIG. 3C) such that the upper region of the shaft 7 cannot exit through the bottom of the main body component 5. In this way, tampering, loss of parts, and other damage is avoided.

Once the upper shaft portion 45 and lower shaft portion 47 are assembled and within the main body component 5, their components are prevented from coming apart due to the close tolerances with each other and the main body component 5.

Figure 8A:
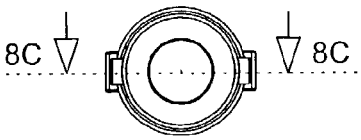
FIGS. 8A-8C include views of a lower portion of the lower component of the crutch, including a breakout view of the bottom of the lower portion.
Figure 8B:
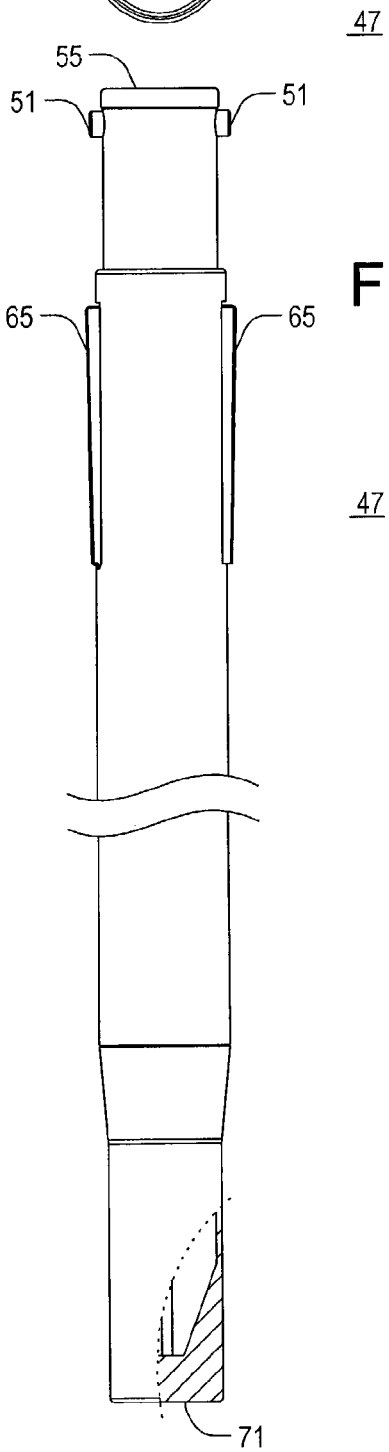
Figure 8C:
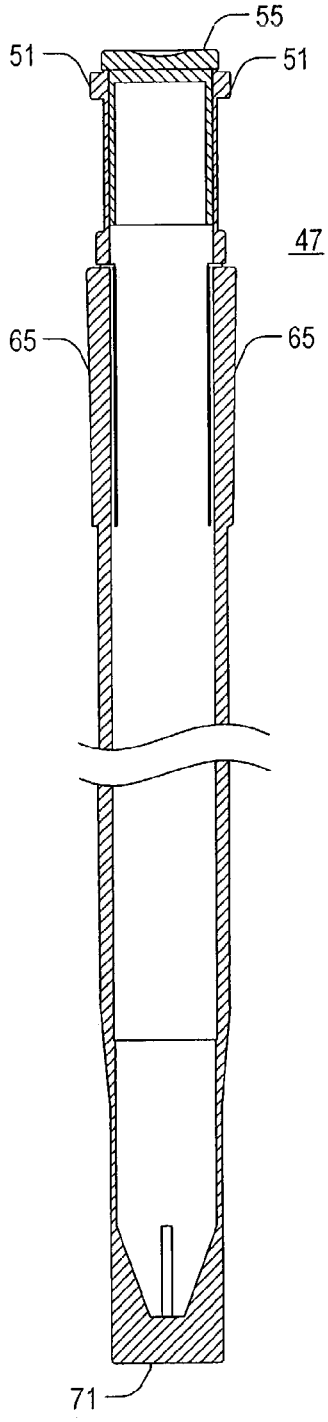

FIGS. 8A-8C include respectively, a top view, a side elevation view, and a side section view of the lower portion 47 of the shaft 7 of the crutch 1. As can be seen, the bottom of the lower portion 47 preferably terminates in a closed end 71 that caps (in the sense of closing off, preferably integrally during manufacture) the preferably hollow lower portion 47 of the shaft 7. The closed end 71 provides a larger surface (as opposed to a tubular open end) over which to distribute axial force on the boot 44 (see FIGS. 6A-6C). This prevents excessive wear on the boot 44 and helps to allow the entire boot 44 to be metal free, as traditional boots have used a metal washer embedded in the footpad to serve the function of reducing wear on the traditional boot.

Figure 9:
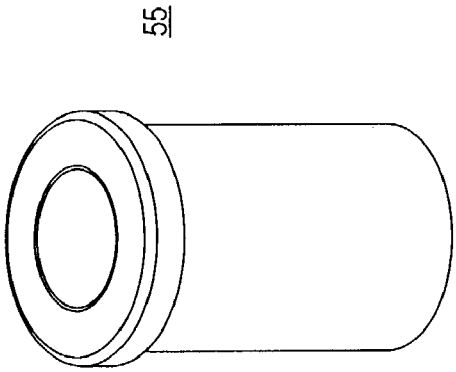
FIG. 9 includes a perspective view of a step cap, seen in, e.g., FIGS. 7B and 8A-8C, from the lower portion of the lower component.

FIG. 9 includes a perspective view of a step cap, seen in, e.g., FIGS. 7B and 8A-8C, from the lower portion of the lower component.

Figure 10C:
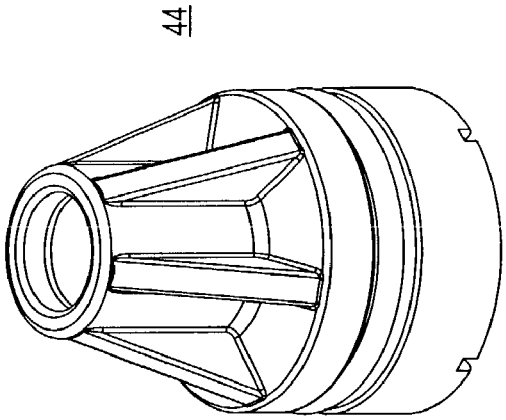
FIGS. 10A-10C include views of a boot, or footpad, that was seen in FIGS. 6A-6C.
Figure 10B:
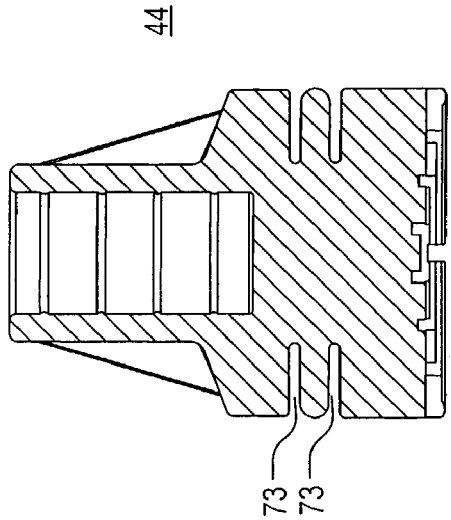
Figure 10A:
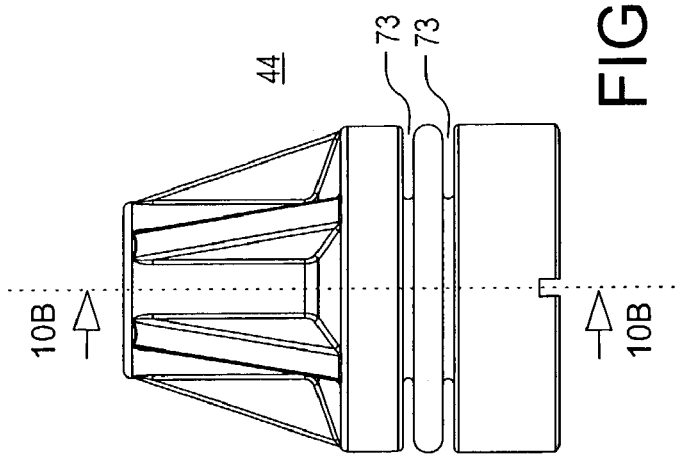
Figure 11A:
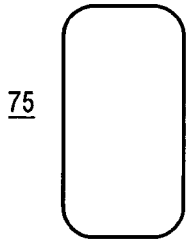
FIGS. 11A-11D include views of an example adjustment pin according to an alternative embodiment of the invention.
Figure 11B:
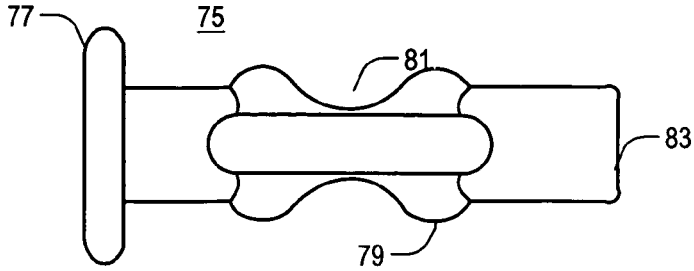
Figure 11C:
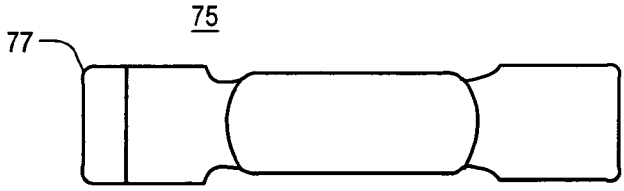
Figure 11D:
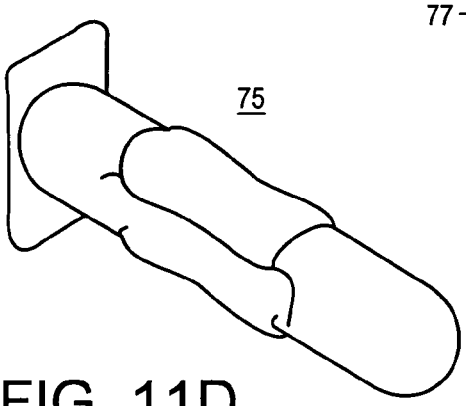

FIGS. 10A-10C include respectively a side elevation view, a front section view, and a perspective view of the boot 44 (that was seen in FIGS. 6A-6C), which is also referred to as the footpad 44. The footpad 44 differs from its predecessors by being shaped to be "missing" one or more rings 73 of material from the exterior of the footpad 44. This results in an accordion-like function, providing extra cushioning for the crutch user. Additionally, the removed ring (or rings) allows the base of the footpad to remain flush with the ground even when weight is applied during use at large angles from the vertical. The material between the "missing" portions can also act to limit footpad flexibility to prevent buckling. This confers greater traction and stability during crutch use. The footpad can be constructed out of any rubber or other polymeric material, but preferably out of a skid-resistant material that does not wear quickly.

According to one particular implementation (e.g., embodiment) of the embodiment of the invention, an underarm crutch has height that can be adjusted by amounts within a range of about 15 inches. This compares very favorably with conventional crutches, which tend to have heights that are adjustable within a much smaller range. The range of adjustment of about 15 inches may, for example, include about 9 inches of adjustment at the interface between the lower and the middle components (with less than about 1/4 of a degree of taper in the receiving cavity) and about 6 inches of adjustment at the interface between the upper and the middle components (with less than about 1/8 of a degree of taper in the receiving hollows). For a higher-quality embodiment, the tapers can further be restricted to less than about 1/8 of a degree, and less than about 1/16 degree, respectively. The crutch may be configured such that the range of heights may be, for example, from about 45 inches to about 60 inches or from about 48 inches to about 62 inches. Other ranges may also be used. For example, a range of adjustment of more than about 9 inches, or more than about 12 inches is also useful. Still other ranges may be used. It is to be understood that the present invention need not be tied to any particular numeric range of adjustment.

In an alternative embodiment of the invention, the integral spring pins 21 and their peninsular springs, as seen in FIGS. 2A-2B, do not exist. Instead, the peninsular spring and its integral spring pin 21 are replaced by a mere hole (not shown) at the location of each integral spring pin 21. Then, separate adjustment pins are used. The adjustment pins may be shaped, for example, as shown in FIGS. 11A-11D. FIGS.

11A-11D include respectively a front elevation view, a side elevation view, a top view, and a perspective view of an example adjustment pin 75. Crutch height is adjusted by telescoping the downwardly extending posts 17 (see, e.g., FIGS. 2A-2C) into the upwardly extending hollow posts 19 (see, e.g., FIGS. 3A-3C) and inserting the separate adjustment pins 75 into selected ones of the vertically spaced holes 23 (see, e.g., FIGS. 3A, 3C) to lock the crutch height. The adjustment pins 75 when removed allow for both of the crutch users' hands to be free to adjust the underarm component 1 to the appropriate height. This height adjustment mechanism does not require the crutch user to apply continuous pressure to depress any spring pins while adjusting the height. A similar adjustment pin (not shown) can be used in adjusting the shaft 7, by similarly replacing the spring pins 59, seen, e.g., in FIGS. 7A-7B, according to the alternative embodiment or another embodiment. Separate adjustment pins may be, for example, separately molded from plastic, or the like. Of course, metal pins may also be used, depending on designer preference.

Figure 12A:
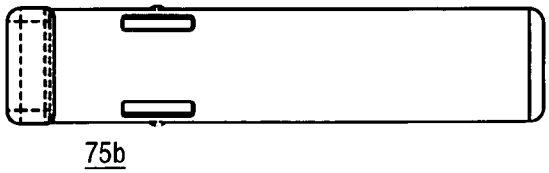
FIGS. 12A-12C include views of another example adjustment pin according to an alternative embodiment of the invention.
Figure 12C:
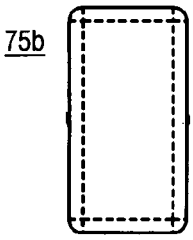
Figure 12B:
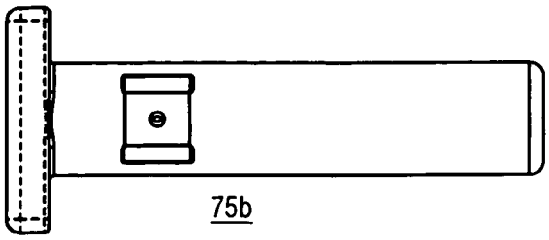

The pin shapes shown in FIGS. 11A-11D are just one possible shape. Other shapes can also be used. For example, a pin having a more substantially cylindrical, dowel shape insertion portion can be used to enhance strength both along the length of the pin and transversely. Such a shape would still have snap features that allows locking in the crutch to prevent inadvertent removal. And such a shape would still have a head. Preferably, the head is still configured to fit within ribs. For example, a rectangular shape having two edges that abut rib walls would orient the pin to ensure that the snap feature on the pin engages as designed. Fitting the head within ribs can reduce or eliminate the amount of pinhead that sticks out from the ribbing and thereby reduce opportunity for the pinhead to catch on items of clothing, hair, other objects, and the like. FIGS. 12A-12C include respectively a top view, a side elevation view, and a front elevation view of such another example adjustment pin 75*b*.

Preferably, the downwardly extending posts 17 and the upwardly extending hollow posts 19 in the alternative embodiment have holes that extend through all material. Thus, each pin 75 (or 75*b*) can penetrate in from one side of an upwardly extending hollow post 19 and have a distal end of the pin 75 poke out from the opposite side of the upwardly extending hollow post 19.

The configuration of pins 75 includes a head 77 and a protrusion 79 and an optional depression 81. The protrusion is compressible to allow entry through the vertically spaced holes of the crutch. The protrusion prevents the pin from being removed from the crutch without firm and concentrated force. A crutch user would apply a force on an end 83 distal from the head to push the pin 75 out slightly to better expose the head 77. The crutch user can then remove the pin 75 by gripping and pulling the head 77. When the pin 75 is secured in the crutch the head preferably rests between ribs 33 (that are seen, e.g., in FIG. 3A) of the main body component 5.

Figure 13:
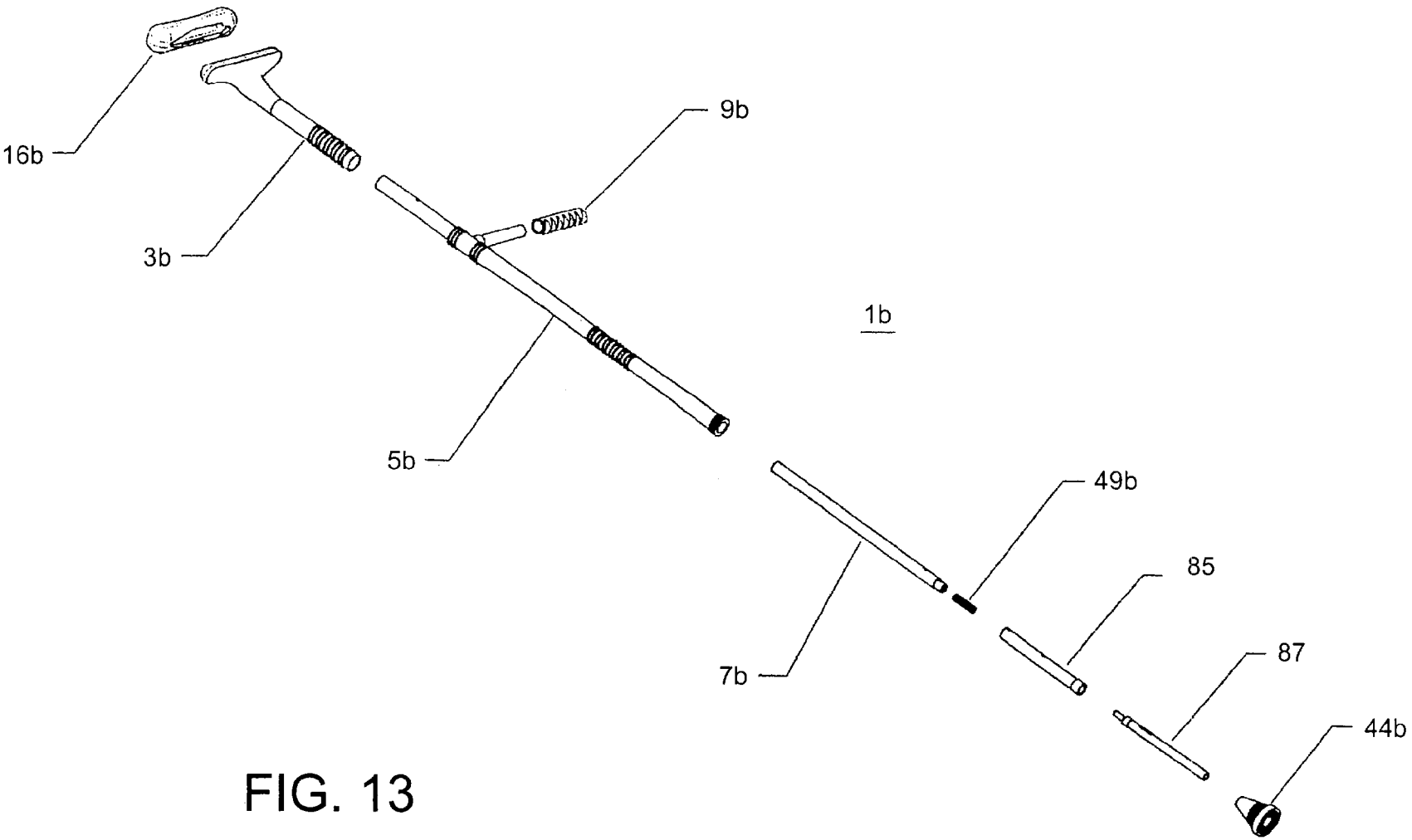
FIG. 13 includes an exploded view of an alternative embodiment of the invention that has a simplified single-post design.
Figure 14A:
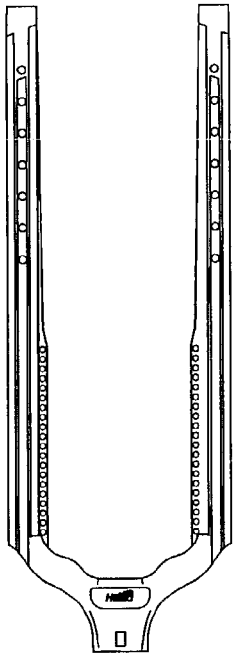
FIGS. 14A-C and 15A-B include views of two parts of a particular, two-part implementation of a main body component FIGS. 16A-C include views of a forearm crutch according to an embodiment of the present invention.
Figure 14B:
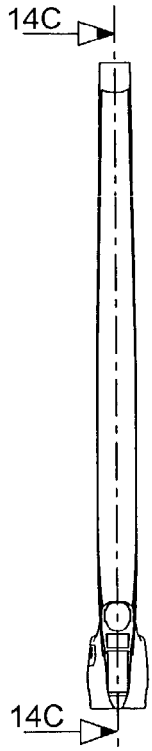
Figure 14C:
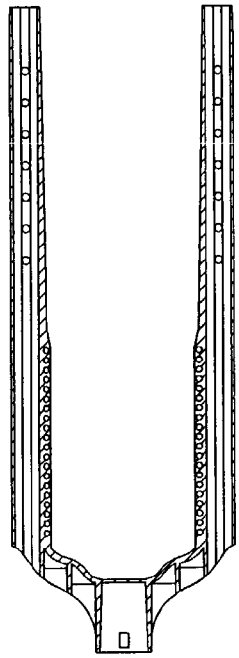
Figure 15A:
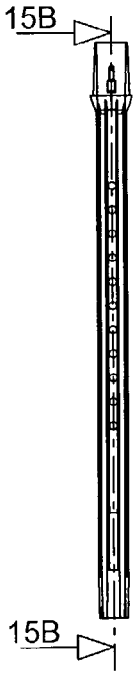
Figure 15B:
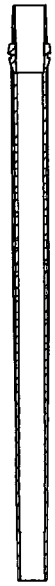

FIG. 13 includes a schematic exploded view of another alternative embodiment 1*b* of the invention that has a simplified single-post design. For simplicity, ribbing is not shown in FIG. 13, even though the alternative embodiment preferably does include ribbing and can include any of the other features discussed in the present document. The alternative embodiment 1*b*, as shown in FIG. 13, includes an upper component 3*b*, a middle component 5*b*, a lower component 7*b*, a handle 9*b*, an underarm pad 16*b*, a boot 44*b*, a shock absorber 49*b*, and members 85 and 87.

FIGS. 14A-C and 15A-B depict views of two parts of a particular, two-part implementation of a main body component. Instead of being integrally molded, the main body component comprises an upper part (FIGS. 14A-C) and a lower part (FIGS. 15A-B, not to same scale as FIGS. 14A-C), which are separately made and then assembled. Having separate parts serves to reduce the size of the mold needed for the main body component, and makes it easier to core the parts in the right direction (such that with taper, the openings in the crutch body fit tightly with sliding parts).

The upper and lower parts of the main body component can be joined, after molding, with a "snap fit," threading (like a screw), or press fit. An adhesive (for example, epoxy-based or the like) can be applied to increase strength between components. Alternatively, without adhesive, the two-part main body component can allow a crutch user to separate the crutch into two segments on demand for ease of storage and transportation. This same feature can also reduce the space required for shipping and storage of the crutch by distributors and healthcare facilities. A removable pin, for example, a pin similar to the pin 75*b* of FIGS. 12A-C, may be used to secure the two halves when assembled.

The lower part of the main body component (see FIGS. 15A-B) can be also be used as the lower part of a two-part separately-injection molded main body component of a forearm crutch (versus underarm crutch). In this way, commonality of parts between an underarm crutch and a forearm crutch is enhanced, and mold costs and other costs are reduced. In short, a main body component of a forearm crutch would have a different upper part, but the same lower part as the main body component of an underarm crutch).

Figure 16A:
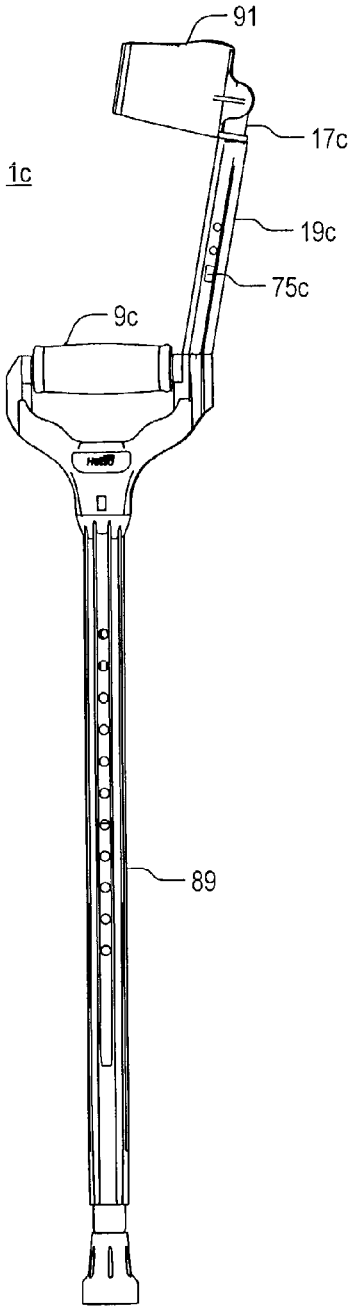
Figure 16B:
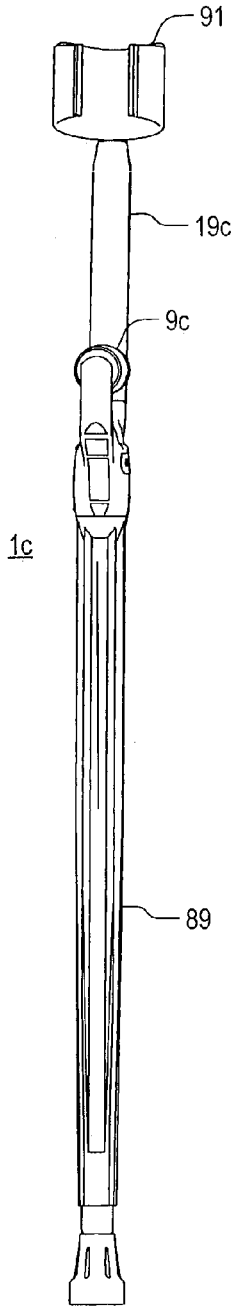
Figure 16C:
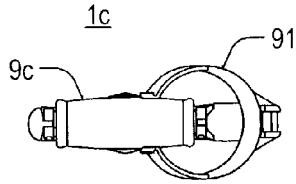

FIGS. 16A-B include a front elevation view and a side perspective view of a forearm crutch 1*c* according to an embodiment of the present invention. FIG. 16C includes a top view of the forearm crutch 1*c*, which is preferably made using polymeric materials as a structural basis and to contain substantially no metal. The forearm crutch 1*c* includes a lower leg 89, a grip handle 9*c*, a forearm post 19*c*, and a cuff 91. The cuff 91 is connected to the rest of the forearm crutch 1*c* via an upper post 17*c*. The lower leg 89 is adjustable in height, as has been discussed above, for example, in connection with the crutch 1 of FIG. 11B. The height position of the cuff 91, relative to the handle 9*c*, is also adjustable via telescoping of the upper post 17*c* into a hollow core of the forearm post 19*c*. Height position of the handle 9*c* is either fixed, in one embodiment, or is separately adjustable, in another embodiment. The user would contact the forearm crutch 1*c* at the handle 9*c* and the cuff 91 during use.

The handle 9*c* of the forearm crutch 1*c* is preferably supported at both ends, as opposed to being fixed at only one end as on traditional models. Further, the lower leg 89 is positioned such that its vertical axis, if extended imaginarily, would intersect the handle 9*c* at a point within the grip of a user's gripping hand, for example, near the center of the handle 9*c*, and/or not at one end of the handle 9*c*. During use, the shown design spreads pressure throughout the palm of the hand, whereas previous designs concentrated the stress between the thumb and forefinger. The reduction in stress concentration could reduce incidence and severity of Carpal Tunnel Syndrome and other repetitive stress injuries caused by crutch use. From a structural design standpoint, supporting the handle on multiple sides reduces torque on the handle relative to the lower leg of the crutch and focuses stresses along the shaft of the lower leg. The forearm crutch 1*c* is shown as being configured to use a detachable upper pin 75*c*, but an integral spring pin, or other locking mechanisms, may also be used. The detachable pin 75*c* may, for example, resemble the detachable pin 75*b* shown in FIGS. 12A-C.

The forearm crutch 1*c* is shown as using a modular, detachable, height-adjustable lower leg 89. Thus, as discussed above, commonality of parts between an underarm crutch and a forearm crutch is achieved, because the lower leg 89 can be a common interchangeable part that is also used within an underarm crutch. (See FIGS. 14A-C and 15A-B.) Furthermore, detaching the lower leg 89 enables more compact storage and transport.

The forearm crutch 1*c* is preferably configured to consolidate the three traditional forearm crutch models junior, adult, and tall adult) into two models. Traditional heights from handle to tip for each model are as follows: Junior—24.5" to 33.5" Adult—28" to 37" Tall Adult—35.5" to 41.5." The forearm crutch 1*c*, in contrast, can be embodied in two sizes to cover the same height range. For example, a medium model can be adjustable between about 24.5 inches to about 32 inches, and a tall model can be adjustable between about 32 inches to about 42 inches. Still other ranges may be used. It is to be understood that the present invention need not be tied to any particular numeric range of adjustment. The configuration of the forearm crutch 1*c* for greater adjustability can simplify inventory for healthcare providers and distributors by eliminating the need for a third product and product code.

Figure 17A:
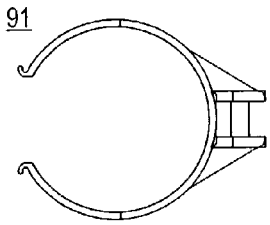
FIGS. 17A-C include views of a cuff of the forearm crutch of FIGS. 16A-C.
Figure 17B:
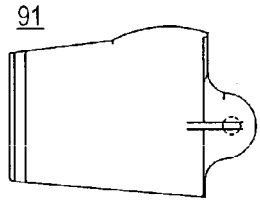
Figure 17C:
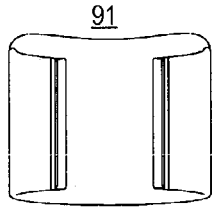
Figure 18E:
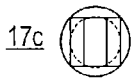
FIGS. 18A-E include views of an upper post 17*c* of the forearm crutch of FIGS. 16A-C.
Figure 18C:
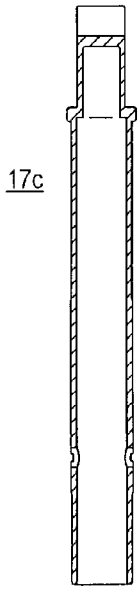
Figure 18A:
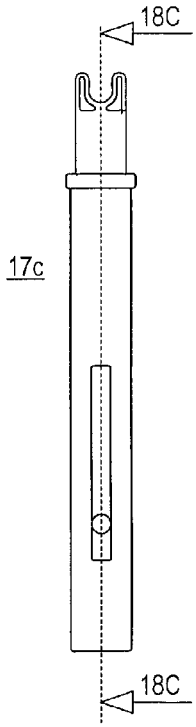
Figure 18B:
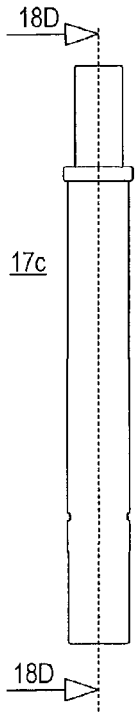
Figure 18D:
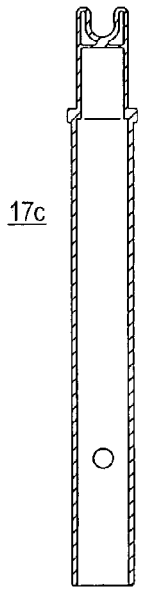

FIGS. 17A-C include a top view, a front view, and a side view, respectively, of the cuff 91. FIGS. 18A-E include a front elevation view, a side elevation view, a rear section view, a front section view, and a top view, respectively, of the upper post 17*c* into which the cuff snaps. The cuff 91 can easily be manually snapped on and off a post 17*c*. The cuff 91 can also be pivoted on the post 17*c*. In contrast, conventional cuffs are bolted, riveted or non-removable. The snap-action detachable connection between the cuff 91 and the rest of the forearm crutch 1*c* allows for easily interchangeable cuffs. Any snapping and pivoting mechanism can be used to connect the cuff 91 and the upper post 17*c*. The particular mechanism illustrated includes a pivot bar on the cuff 91, and a snap-action receiver on the upper post 17*c* that receives the pivot bar.

Below, specific example embodiments of the invention are discussed.

EXAMPLE X1

An underarm crutch comprises an underarm support that is placed underarm of a person during use; and at least one elongated member that bears weight and that includes a polymeric material as a structural basis, wherein the underarm support is coupled to the at least one member to help support weight of the person;

wherein the underarm crutch has height during use, a substantial portion of which height is contributed by the at least one elongated member; and wherein the underarm crutch comprises substantially no metal, whereby the underarm crutch is capable of not triggering an alarm by an airport metal detector.

EXAMPLE X2

An apparatus for helping to support weight of a person the apparatus comprising:

a crutch that is substantially composed of injection molded plastic and that includes no metal;

wherein the crutch, when viewed using x-ray, has appearance that differs from appearance of a metal crutch.

EXAMPLE X3

A crutch, the crutch having a height, the crutch comprising:

a first member;

a second member slidably and lockably connected to the first member to permit, when not locked, substantially linear movement of the first and second members relative to each other, hereinafter referred to as first relative movement, wherein the first relative movement provides a first change of the height of the crutch to help accommodate body height of a user;

a third member slidably and lockably connected to the second member to permit, when not locked, substantially linear movement of the second and third members relative to each other, hereinafter referred to as second relative movement, wherein the second relative movement provides a second change of the height of the crutch to help accommodate the body height of the user, and wherein the first and second changes are distinct from one another.

EXAMPLE X4

An apparatus for helping to support weight of a person during ambulation, the apparatus having a length, hereinafter referred to as apparatus length, along a direction of the apparatus, the apparatus comprising:

a first stage;

a second stage adjustably connected to the first stage, the adjustably connected first and second stages together spanning a length, hereinafter referred to as first sub-length, along the direction of the apparatus, wherein the first and second stages are adjustably connected to permit change in position of the adjustably connected first and second stages relative to each other to alter the first sub-length, a portion of the first sub-length accounting for a first portion of the apparatus length; and a third stage adjustably connected to the second stage, the adjustably connected second and third stages together spanning a length, hereinafter referred to as second sub-length, along the direction of the apparatus, wherein the second and third stages are adjustably connected to permit change in position of the adjustably connected second and third stages relative to each other to alter the second sub-length, a portion of the second sub-length accounting for a second portion of the apparatus length, the second portion being distinct from the first portion of the apparatus length;

wherein the first, second, and third stages are configured that the apparatus length is adjustable by altering the first and second sub-lengths; and wherein altering the first sub-length is capable of contributing a first adjustment to the apparatus length, and altering the second sub-length is capable of contributing a second adjustment to the apparatus length, the first adjustment being other than the second adjustment.

EXAMPLE X5

An apparatus for assisting in mobility of a person, the apparatus comprising:

a crutch having a length along an axis; and at least two adjustment points on the crutch, wherein the length, hereinafter referred to as crutch length, is adjustable at the adjustment points, whereby the crutch is customizable for accommodating body dimensions of an intended user;

wherein the adjustment points include a first and a second adjustment point, and the first adjustment point is configured to, at least occasionally, contribute an adjustment to the crutch length that is not merely an adjustment that is being contributed by the second adjustment point.

EXAMPLE X6

A crutch, the crutch having a height when positioned vertically, the crutch comprising:

an underarm saddle at an upper end of the crutch that engages a person underarm;

a multipart body coupled to the underarm saddle, the multipart body configured to permit adjustment of height of the crutch to heights including a height that is less than about 50 inches and a height that is more than about 59 inches.

EXAMPLE X7

A method for producing a mobility-assistance device the mobility-assistance device having a device length, the method comprising the steps of:

providing a first member;

providing a second member;

providing a third member;

slideably connecting the first member to the second member, wherein sliding between the first and second members alters the device length by a first adjustment contribution; and slideably connecting the third member to the second member, wherein sliding between the third and second members alters the device length by a second adjustment contribution, the first and second adjustment contributions together contributing an adjustment adjustment of the device length that is greater than either one of the first and second adjustment contributions.

EXAMPLE X8

A method for adjusting longitudinal length of a mobility-assistance device, wherein the mobility-assistance device includes a multi-part body and at least a first and a second adjustment point on the mobility-assistance device, wherein the longitudinal length, hereinafter referred to as device length, is adjustable at the first and second adjustment points, whereby the mobility-assistance device is customizable for accommodating body dimensions of an intended user, the method comprising adjusting the mobility-assistance device at the first adjustment point to obtain a first adjustment to the device length; and adjusting the mobility-assistance device at the second adjustment point to obtain a second adjustment to the device length, wherein the first and second adjustments together contribute a total adjustment that is not merely either of the first and second adjustments alone.

EXAMPLE X9

A device for enhancing mobility of a physically-impaired person, the device comprising:

a first member that comprises an elongated portion; and a second member that is configured to slidably receive the elongated portion of the first member and to have negative draft relative to the elongated portion of the first member.

EXAMPLE X10

An apparatus for helping to support weight of a person during ambulation, the apparatus comprising:

a first stage that includes an elongated portion; and a second stage that defines a cavity that slidably receives the elongated portion of the first stage along an axis of sliding, the cavity having an opening that receives the elongated portion of the first stage, the second stage including an internal sidewall facing the cavity, at least a portion of the internal sidewall being tapered relative to the axis of sliding, wherein a first point on the internal sidewall deviates more, from the axis of sliding as envisioned centrally in the cavity, than does a second point on the internal sidewall, the first point on the internal sidewall being deeper in the cavity along the centrally-envisioned axis of sliding than the second point on the internal sidewall.

EXAMPLE X11

A method for producing an apparatus for assisting in ambulation, the method comprising the steps of:

providing a first member that comprises an elongated portion; and providing a second member, including:

forming a recess in the second member for slidably receiving the elongated portion of the first member; and tapering the recess to have negative draft relative to the elongated portion of the first member.

EXAMPLE X12

A mold for molding a portion of a device for assisting in ambulation, the portion hereinafter referred to as first member, the device further to include a second member that includes an elongated portion, the first member to include a cavity and an exterior, the cavity to include at least a first external opening, the cavity to accept the elongated portion of the second member through the first external opening along an axis of insertion, the axis of insertion having a direction of insertion of the second member and an opposite direction of withdrawal of the second member, the mold comprising:

a form configured to shape the exterior of the first member; and a core configured to shape the cavity of the first member; the core being configured and disposed to separate from the first member in a direction other than the direction of withdrawal of the second member.

EXAMPLE X13

A method for molding a portion of a mobility-assistance device, the portion hereinafter referred to as first member, the device further to include a second member that includes an elongated portion, the first member to include a cavity and an exterior, the cavity to include at least a first entryway, the cavity to accept the elongated portion of the second member through the first entryway along an axis of insertion, the axis of insertion having a direction of insertion of the second member and an opposite direction of withdrawal of the second member, the method comprising the steps of:

molding the first member including defining the cavity using a mold core; and withdrawing the mold core from the first member in a direction other than the direction of withdrawal of the second member.

EXAMPLE X14

An apparatus for assisting in ambulation, comprising a first member;

a second member adjustably connected to the first member, wherein the first and second members together span an adjustable height; and at least one tab, integrally formed on the first member, that, when engaged, opposes adjustment of the adjustable height.

EXAMPLE X15

A crutch, the crutch comprising a multipart body having an adjustable overall axial length, wherein the multipart body comprises at least a first part and a second part, and axial positioning of the first and second parts relative to each other contributes to adjustment of the overall axial length; and at least one stop, integral with the first part, that, when engaged, fixes relative axial position between the first and second parts, wherein the stop is not merely a bore through the first part.

EXAMPLE X16

A method for producing an apparatus for assisting in mobility of a physically-impaired person, the method comprising:

forming a first member including integrally forming a stop on the first member, wherein the stop is not merely a bore through the first member;

providing a second member; and adjustably connecting the second member to the first member, wherein the first and second members together span an adjustable height, and wherein the stop is configured as capable of being engaged to oppose relative motion against the second member to thereby oppose adjustment of the adjustable height.

EXAMPLE X17

An apparatus for assisting in ambulation, the apparatus comprising:

a first member that includes an exterior, wherein the first member is made using a mold that includes at least a first form unit that forms a first portion of the exterior and a second form unit that forms a second portion of the exterior, there being at least one boundary, not necessarily visibly marked, on the exterior between the first and second portions of the exterior;

a second member adjustably connected to the first member, the first and second members together spanning an adjustable axial length; and a lock that, when engaged, fixes the adjustable axial length against at least one of contraction or expansion, wherein the lock engages, or exists on, the first member not on the at least one boundary on the exterior of the first member.

EXAMPLE X18

A method for producing an apparatus for assisting in mobility of a physically-impaired person, the method comprising:

molding a first member using a mold that includes at least a first form unit that forms a first portion of the exterior and a second form unit that forms a second portion of the exterior, there being at least one boundary, not necessarily visibly marked, on the exterior between the first and second portions of the exterior;

providing a second member to adjustably connect to the first member, the first and second members together spanning an adjustable axial length; and providing a lock that, when engaged, fixes the adjustable axial length against at least one of contraction or expansion, wherein the lock engages, or exists on, the first member not on the at least one boundary on the exterior of the first member.

EXAMPLE X19

A device for assisting in ambulation, the device having a longitudinal axis, the device comprising:

a lower body portion that includes an elongated, weight-bearing first member at top of the lower body portion when the device is positioned substantially vertically to support weight of a user, the lower body portion having no other elongated, weight-bearing member at top of the lower body portion parallel to the first member when the device is positioned substantially vertically; and an upper body portion that includes an elongated second member at bottom of the upper body portion, the second member being adjustably connected to the first member, adjustment of the connection for adjustment of device height;

wherein each of the first and the second members is integrally shaped to oppose relative rotation between the second member and the first member around the longitudinal axis.

EXAMPLE X20

A method for producing an apparatus for enhancing mobility of a physically-impaired person, the apparatus having a longitudinal axis, the method comprising:

forming a lower body portion that includes an elongated first member that is to bear weight and be at top of the lower body portion when the apparatus is positioned substantially vertically to support weight of a user, the lower body portion having no other elongated, weight-bearing member at top of the lower body portion parallel to the first member when the apparatus is positioned substantially vertically; and forming an upper body portion that includes an elongated second member at bottom of the upper body portion, the second member being adjustably connected to the first member, adjustment of the connection for adjustment of apparatus height;

wherein the forming steps comprise integrally shaping each of the first and the second members to oppose relative rotation between the first and second members around the longitudinal axis.

EXAMPLE X21

A crutch comprising a body having an upper end and a lower end, the body comprising a strut at the lower end, the strut terminating in a lower tip, the lower tip being integral with and of a same material as the strut; and an end cap that attaches to the body at the lower tip not via overmolding, the end cap engaging the ground during use of the crutch, the end cap integrally made of a resilient material, wherein the end cap is attached to the strut without any intervening washer or baseplate, the intervening washer or baseplate not being integral with and not being integrally formed with either the strut or the end cap.

EXAMPLE X22

A mobility assistance device comprising a body having an upper end and a lower end, the body comprising an elongated member at the lower end, the elongated member terminating at the lower end in a lower tip, the lower tip being formed integrally with the elongated member and being without any substantial flange, the lower tip having at least one bottom surface; the elongated member being elongated along a longitudinal axis; and a resilient ground contact that attaches to the body at the lower tip, the ground contact engaging the ground during use of the crutch;

wherein the body transfers weight to the ground contact axially via the at least one bottom surface of the lower tip, and overall area of the at least one bottom surface is substantially greater than non-empty area of a cross section of the elongated member perpendicular to the longitudinal axis.

EXAMPLE X23

A method for producing a crutch, the method comprising:

forming a body having an upper end and a lower end, the body comprising a strut at the lower end, the strut terminating in a lower tip, the lower tip being integral with and of a same material as the strut;

providing an ground-contact piece that is made of a resilient material; and attaching the ground-contact piece to the body at the lower tip not via overmolding and without any intervening washer or baseplate, the attached ground-contact piece for engaging the ground during use of the crutch.

EXAMPLE X24

A ground contact article for connecting onto a bottom tip portion of a mobility assistance device, the ground contact article comprising:

a body that includes a resilient material as a structural basis and that includes a top end and a bottom surface, the bottom surface for engaging ground, the body for receiving weight of the mobility assistance device from above;

wherein the body is configured to include at least one collapsing region positioned between the top end and the bottom surface, the at least one collapsing region being configured to permit a peripheral portion of the body to collapse more readily than a central portion of the body to thereby permit the bottom surface to remain flush with the ground even when the mobility assistance device is moved such that angle between the mobility assistance device and the ground is changed substantially, relative to an initial angle.

EXAMPLE X25

A method for producing a ground contact article for connecting onto a bottom tip portion of a mobility assistance device, the method comprising:

molding a body of a resilient material, the body including a top end and a bottom surface, the bottom surface for engaging ground, the body for receiving weight of the mobility assistance device from above, the molding step including:

configuring the body to include at least one collapsing region positioned between the top end and the bottom surface; and configuring the at least one collapsing region to permit a peripheral portion of the body to collapse more readily than a central portion of the body to thereby permit the bottom surface to remain flush with the ground even when the mobility assistance device is moved such that angle between the mobility assistance device and the ground is changed substantially, relative to an initial angle.

EXAMPLE X26

A crutch, comprising a crutch body having an upper end and a lower end, the lower end for engaging the ground during ambulation; and a variable-spring-rate spring coupled to the crutch body to provide shock absorption for the crutch, wherein the spring provides greater spring rate with increased compression of the spring.

EXAMPLE X27

A device for assisting ambulation, the device comprising:

a first member;

a second member; and a resilient body, comprising an elastomeric material, coupled to the first and second members to transmit physical force between the first and second members to provide shock absorption for the device.

EXAMPLE X28

An apparatus for assisting in mobility of a physically-impaired person, the apparatus comprising:

at least one member that supports some weight of the disabled person in the course of using the apparatus; and a material of lower durometer than the at least one member, the material coupled to the at least one member to provide shock absorption for the apparatus, wherein the material, at each of multiple points along an axis of compression, has thickness perpendicular to the axis of compression, the thicknesses of the multiple points being substantially non-equal to one another, whereby spring rate of the material is substantially different depending on amount of compression.

EXAMPLE X29

A method for producing a crutch, comprising:

providing a crutch body having an upper end and a lower end, the lower end for engaging the ground during ambulation; and coupling a variable-spring-rate spring to the crutch body to provide shock absorption for the crutch, wherein the spring provides greater spring rate with increased compression of the spring.

EXAMPLE X30

A method for producing an apparatus for assisting ambulation of a person, the method comprising:

providing at least one member that supports some weight of the person in the course of using the apparatus; and forming a material of lower durometer than the at least one member, wherein the material, at each of multiple points along an axis of compression, has thickness perpendicular to the axis of compression, the thicknesses of the multiple points being substantially nonequal to one another, whereby spring rate of the material is substantially different depending on amount of compression; and coupling the material to the at least one member to provide shock absorption for the apparatus.

Further example embodiments of the invention can be made, each by combining any number of, and any of, the features, elements, or embodiments discussed in the present document, including all documents incorporated by reference, with each other and/or with conventional features, elements, or devices, unless the combination is impossible due to contradiction between the specific example features, elements, or embodiments that are being contemplated for combination.

Throughout the description and drawings, example embodiments have been given with reference to specific configurations. It will be appreciated by those of ordinary skill in the present art that the present invention can be embodied in other specific forms without departing from the spirit and scope of the present invention. For example, even though some embodiments of the invention show an upper part telescoping into a lower part, or vice versa, an opposite configuration can also be used—i.e., having a lower part telescoping into an upper part, or vice versa. For another example, even though some embodiments of the invention use a telescoping connection, any other type of adjustable connections may also be used. The scope of the invention is not limited merely to the specific example embodiments of the foregoing description, but rather is indicated by the appended claims. All changes and modifications that come within the meaning and range of equivalents within the claims are intended to be considered as being embraced within the scope of the claims.

What is claimed is:

1. A device for enhancing mobility of a physically-impaired person, the device comprising:

a first member that comprises an elongated portion; and a second member that is configured to slidably receive the elongated portion of the first member and to have negative draft relative to the elongated portion of the first member;

wherein extent of slidably receiving of the elongated portion of the first member by the second member helps determine at least two usable heights of the device for enhancing mobility, the device helping support weight of a person, including support in a direction of the slideably receiving;

wherein the second member comprises plastic as a basis;

wherein the second member defines a cavity that slidably receives the elongated portion of the first member along an axis of sliding, the cavity including an opening that receives the elongated portion of the first member, wherein internal diameter of the cavity becomes progressively greater with increasing depth along a segment of the cavity along the axis of sliding;

wherein the negative draft is at least an eighth of a degree from being parallel to the axis of sliding along the segment of the cavity.

2. A device according to claim 1, wherein there are at least two achievable depths of insertion of the elongated portion of the first member into the cavity, the two possible depths differing from one another by at least six inches.

3. A device according to claim 2, wherein the segment of the cavity is at least twenty inches deep along the axis of sliding, and the negative draft is at least a quarter of a degree from being parallel to the axis of sliding along the segment of the cavity.

4. A device according to claim 2, wherein the negative draft is no more than a half of a degree from being parallel to the axis of sliding along the segment of the cavity.

5. A device for enhancing mobility of a physically-impaired person, the device comprising:

a first member that comprises an elongated portion; and a second member that is configured to slidably receive the elongated portion of the first member and to have negative draft relative to the elongated portion of the first member;

wherein extent of slidably receiving of the elongated portion of the first member by the second member helps determine at least two usable heights of the device for enhancing mobility, the device helping support weight of a person, including support in a direction of the slideably receiving;

wherein the second member comprises plastic as a basis;

wherein the second member defines a cavity that slidably receives the elongated portion of the first member along an axis of sliding, the cavity including an opening that receives the elongated portion of the first member, wherein internal diameter of the cavity becomes progressively greater with increasing depth along a segment of the cavity along the axis of sliding;

wherein:

the cavity is hereinafter referred to as first cavity;

the axis of sliding is hereinafter referred to as first axis of sliding;

the device further comprises a third member having an elongated portion; and the second member further defines a second cavity that slidably receives the elongated portion of the third member along a second axis of sliding and has negative draft relative to the elongated portion of the third member.

6. A device according to claim 5, wherein the negative draft relative to the elongated portion of the third member is at least an eighth degree more than zero draft along a segment of the second cavity along the second axis of sliding, and the segment of the second cavity is at least six inches deep along the second axis of sliding.

7. A device according to claim 6, wherein the segment of the second cavity is at least fifteen inches deep along the second axis of sliding.

8. A device according to claim 6, wherein the negative draft relative to the elongated portion of the first member is at least a quarter degree more than zero draft along the segment of the first cavity along the first axis of sliding.

9. A device according to claim 8, wherein the segment of the first cavity is at least twenty inches deep along the axis of sliding, and wherein depth of insertion of the elongated portion of the first member into the first cavity is user-adjustable, the depth of insertion of the elongated portion of the first member into the first cavity capable of achieving depths including two depths that differ from each another by at least six inches.

10. A device for enhancing mobility of a physically-impaired person, the device comprising:

a first member that comprises an elongated portion; and a second member that is configured to slidably receive the elongated portion of the first member and to have negative draft relative to the elongated portion of the first member;

wherein the elongated portion includes a spring support that presses against the second member to resist play by the first member relative to the second member, despite the negative draft, even when slideably receiving of the elongated portion of the first member by the second member is at more than a minimum extent;

wherein:

the second member comprises plastic as a basis;

the second member defines a cavity that slidably receives the elongated portion of the first member along an axis of sliding, the cavity including an opening that receives the elongated portion of the first member, wherein internal diameter of the cavity becomes progressively greater with increasing depth along a segment of the cavity along the axis of sliding;

the cavity is hereinafter referred to as first cavity;

the axis of sliding is hereinafter referred to as first axis of sliding;

the device further comprises a third member having an elongated portion;

the second member further defines a second cavity that slidably receives the elongated portion of the third member along a second axis of sliding and has negative draft relative to the elongated portion of the third member; and the spring support is hereinafter referred to as first spring support;

the elongated portion of the third member includes a second spring support that presses against the second member to resist play by the third member relative to the second member despite negative draft, even when slideably receiving of the elongated portion of the third member by the second member is at more than a minimum extent.

11. A device for enhancing mobility of a physically-impaired person, the device comprising:

a first member that comprises an elongated portion; and a second member that is configured to slidably receive the elongated portion of the first member and to have negative draft relative to the elongated portion of the first member;

wherein extent of slidably receiving of the elongated portion of the first member by the second member helps determine at least two usable heights of the device for enhancing mobility, the device helping support weight of a person, including support in a direction of the slideably receiving;

wherein the second member comprises plastic as a basis;

wherein the second member defines a cavity that slidably receives the elongated portion of the first member along an axis of sliding, the cavity including an opening that receives the elongated portion of the first member, wherein internal diameter of the cavity becomes progressively greater with increasing depth along a segment of the cavity along the axis of sliding;

wherein:

the cavity is hereinafter referred to as first cavity;

the elongated portion of the first member is hereinafter referred to as first elongated portion;

the second member is configured to slidably receive the elongated portion of the first member along an axis of sliding;

the first member further comprises a second elongated portion; and the second member is further configured to slidably receive the second elongated portion of the first member along the axis of sliding and to have negative draft relative to the second elongated portion of the first member.

12. A device for enhancing mobility of a physically-impaired person, the device comprising:

a first member that comprises an elongated portion; and a second member that is configured to slidably receive the elongated portion of the first member and to have negative draft relative to the elongated portion of the first member;

wherein extent of slidably receiving of the elongated portion of the first member by the second member helps determine at least two usable heights of the device for enhancing mobility, the device helping support weight of a person, including support in a direction of the slideably receiving; and wherein the device further comprises a third member having an elongated portion, and the second member is further configured to slidably receive the elongated portion of the third member and to have negative draft relative to the elongated portion of the third member.

13. A device according to any one of claims 1-11 and 12, wherein the device is an underarm crutch.

14. A device according to any one of claims 1-11 and 12, wherein the device is a crutch.

15. A method for producing an apparatus for assisting in ambulation, the method comprising the steps of:

providing a first member that comprises an elongated portion; and providing a second member, including:

forming a recess in the second member for slidably receiving the elongated portion of the first member; and tapering the recess to have negative draft relative to the elongated portion of the first member;

wherein the first and second members are configured for extent of slidably receiving of the elongated portion of the first member by the second member to help determine at least two usable heights of the apparatus for assisting in ambulation for enhancing mobility, the apparatus helping to support weight of a person, including support in a direction of the slideably receiving;

wherein the step of providing a second member comprises molding the second member of a plastic-based material;

wherein the recess includes a cavity that slidably receives the elongated portion of the first member along an axis of sliding, the cavity including an opening that receives the elongated portion of the first member, wherein internal diameter of the cavity becomes progressively greater with increasing depth along a segment of the cavity along the axis of sliding;

wherein:

the cavity is hereinafter referred to as first cavity;

the axis of sliding is hereinafter referred to as first axis of sliding;

the method further comprises providing a third member having an elongated portion; and the step of providing the second member further comprises forming a second cavity in the second member that slidably receives the elongated portion of the third member along a second axis of sliding and has negative draft relative to the elongated portion of the third member.

16. An apparatus produced using the method according to claim 15.

17. A method according to claim 15, wherein the step of forming the second cavity in the second member comprises forming the second cavity in the second member to obtain a negative draft, relative to the elongated portion of the third member, that is at least an eighth degree more than zero draft along an at least six inches deep segment of the second cavity along the second axis of sliding.

18. A method according to claim 17, wherein the tapering step comprises tapering the recess to have a negative draft, relative to the elongated portion of the first member, that is at least a quarter degree more than zero draft along the segment of the first cavity along the first axis of sliding.

19. A method according to claim 17, wherein the tapering step comprises tapering the recess to have a negative draft, relative to the elongated portion of the first member, that is at least a quarter degree more than zero draft along an at least twenty inches deep segment of the first cavity along the first axis of sliding; and wherein the forming step comprises forming the recess in the second member for slidably receiving the elongated portion of the first member to obtain user adjustable depth of insertion of the elongated portion of the first member into the first cavity, and to obtain depth of insertion of the elongated portion of the first member into the first cavity that is capable of achieving depths including two depths that differ from each another by at least six inches.

20. A method according to claim 15, wherein the step of forming the second cavity in the second member comprises forming the second cavity in the second member to obtain a negative draft, relative to the elongated portion of the third member, that is at least an eighth degree more than zero draft along an at least fifteen inches deep segment of the second cavity along the second axis of sliding.

21. A method according to claim 15, wherein the step of forming the second cavity in the second member comprises forming the second cavity in the second member to obtain a negative draft, relative to the elongated portion of the third member, that is at least an eighth degree more than zero draft along an at least six inches deep segment of the second cavity along, as the second axis of sliding, an axis substantially parallel to the first axis of sliding.

22. A method for producing a crutch, according to claim 15, wherein the apparatus for assisting in ambulation is a crutch.

* * * * *